US007982416B2

(12) United States Patent
Tanaka et al.

(10) Patent No.: US 7,982,416 B2
(45) Date of Patent: Jul. 19, 2011

(54) CIRCULAR ACCELERATOR

(75) Inventors: Hirofumi Tanaka, Tokyo (JP); Takashi Hifumi, Tokyo (JP); Katsuhisa Yoshida, Tokyo (JP); Kazuo Yamamoto, Tokyo (JP); Yoichi Kuroda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 422 days.

(21) Appl. No.: 12/277,861

(22) Filed: Nov. 25, 2008

(65) Prior Publication Data

US 2009/0256501 A1 Oct. 15, 2009

(30) Foreign Application Priority Data

Apr. 15, 2008 (JP) ..... 2008-105608

(51) Int. Cl.
*H05H 11/00* (2006.01)

(52) U.S. Cl. ..... 315/504; 315/503; 315/505; 315/507

(58) Field of Classification Search ..... 315/500–507
See application file for complete search history.

(56) References Cited

U.S. PATENT DOCUMENTS

| | | | | |
|---|---|---|---|---|
| 5,117,212 | A * | 5/1992 | Yamamoto et al. | 335/210 |
| 5,576,602 | A | 11/1996 | Hiramoto et al. | |
| 6,992,312 | B2 * | 1/2006 | Yanagisawa et al. | 250/492.3 |

FOREIGN PATENT DOCUMENTS

| | | |
|---|---|---|
| JP | 2-201899 | 8/1990 |
| JP | 5-196799 | 8/1993 |
| JP | 7-111199 | 4/1995 |
| JP | 11-74100 | 3/1999 |
| JP | 2005-116372 | 4/2005 |

* cited by examiner

*Primary Examiner* — Anh Q Tran
(74) *Attorney, Agent, or Firm* — Oblon, Spivak, McClelland, Maier & Neustadt, L.L.P.

(57) ABSTRACT

In a circular accelerator, a magnetic pole edge portion of a bending electromagnet into and from which a charged particle beam enters and exits is provided with endpacks. A first protrusion is provided at that part of each end pack which is radially outside the equilibrium orbit of a center energy beam, while a second protrusion is provided at that part of each end pack which is radially inside the equilibrium orbit of the center energy beam. The shapes of the first and second protrusions are set so that the betatron oscillation numbers of beams of different acceleration energies may be held constant or become linear to the energies. In case of emitting the charged particle beam out of the circular accelerator, the change of a tune attributed to the change of the beam orbit can be statically corrected, the tune is linearly changed, and an adjustment of the emission of the beam becomes easy.

7 Claims, 13 Drawing Sheets

【FIG 1】
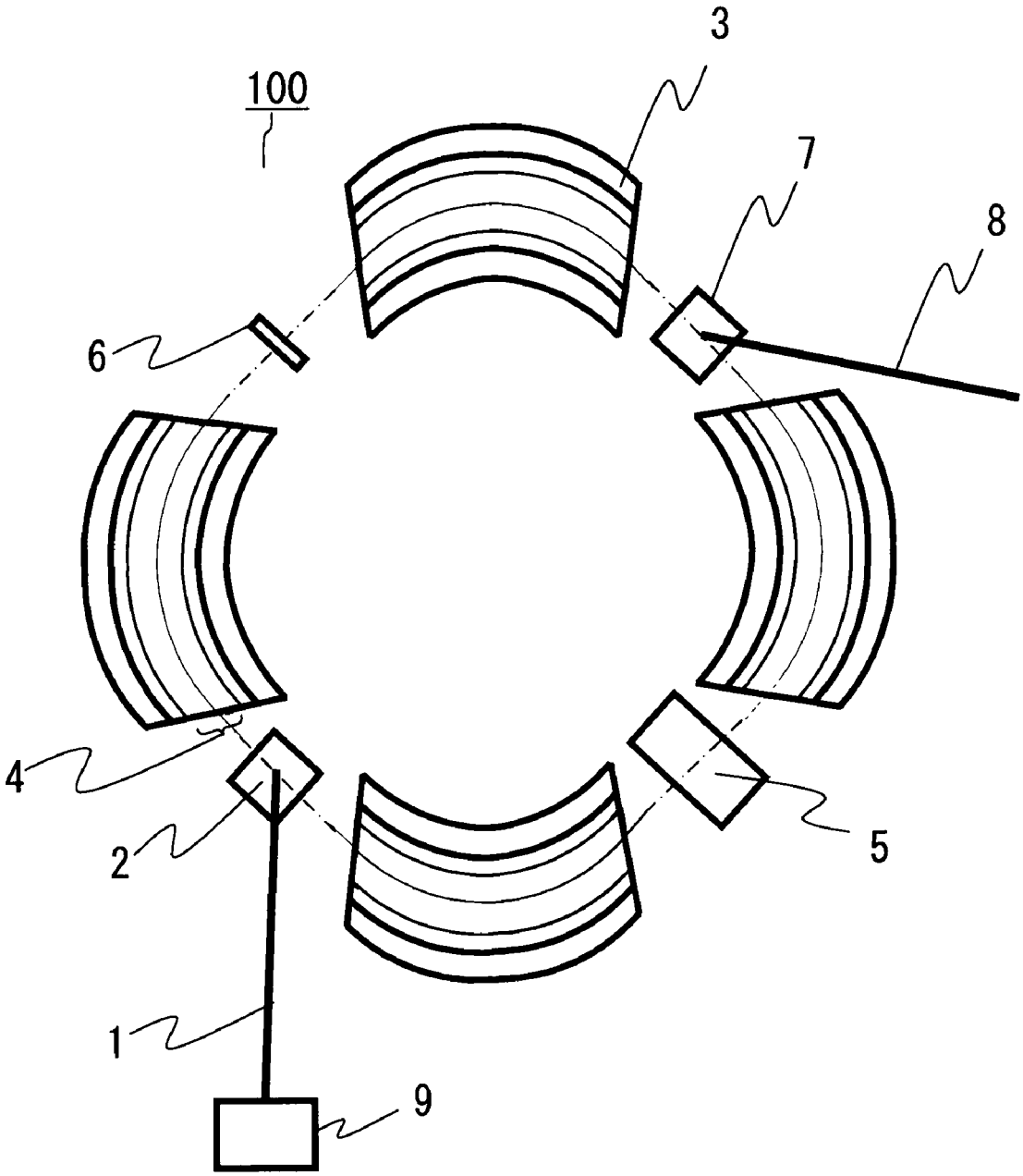

【FIG 2】
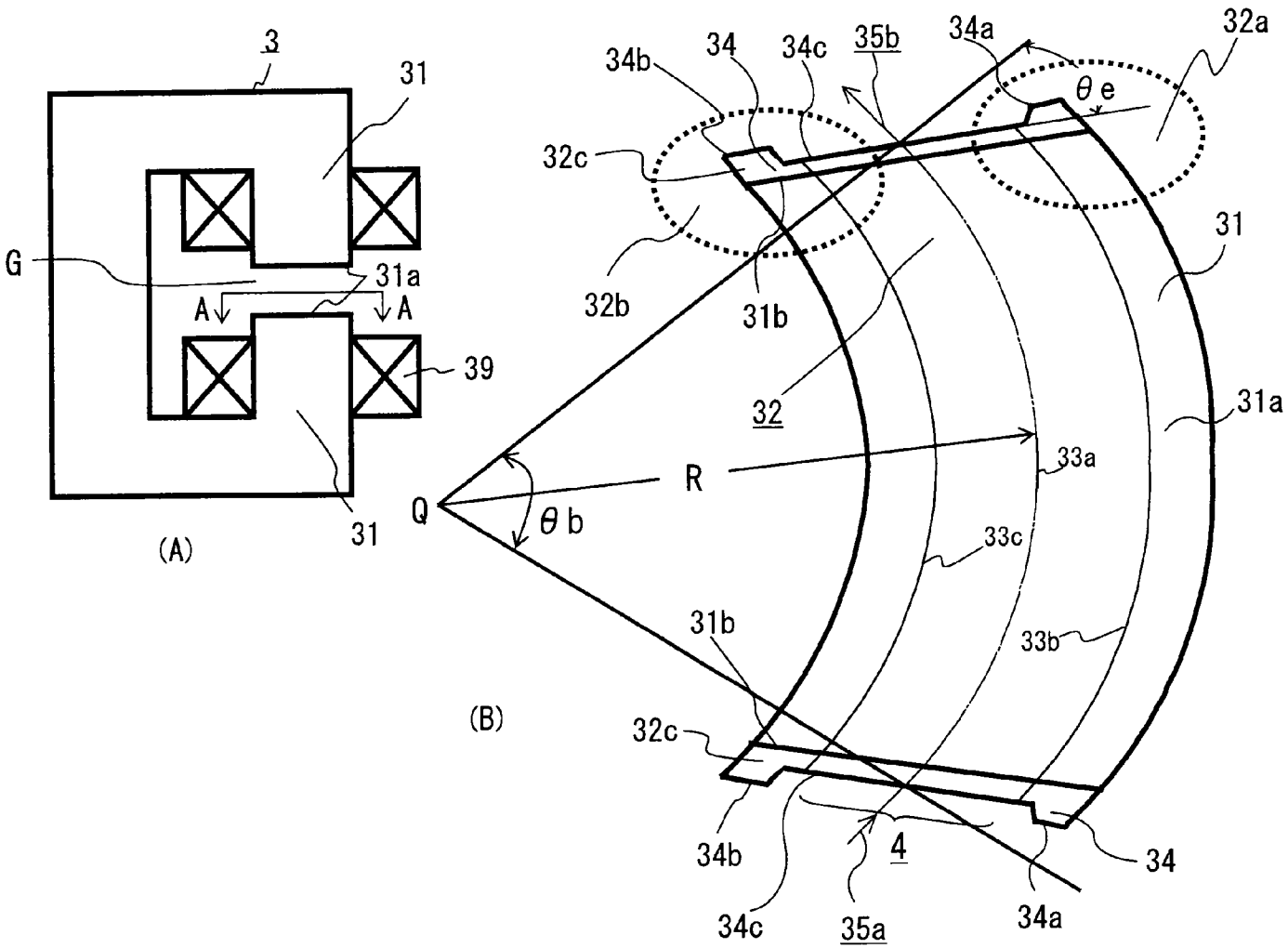

【FIG 3】
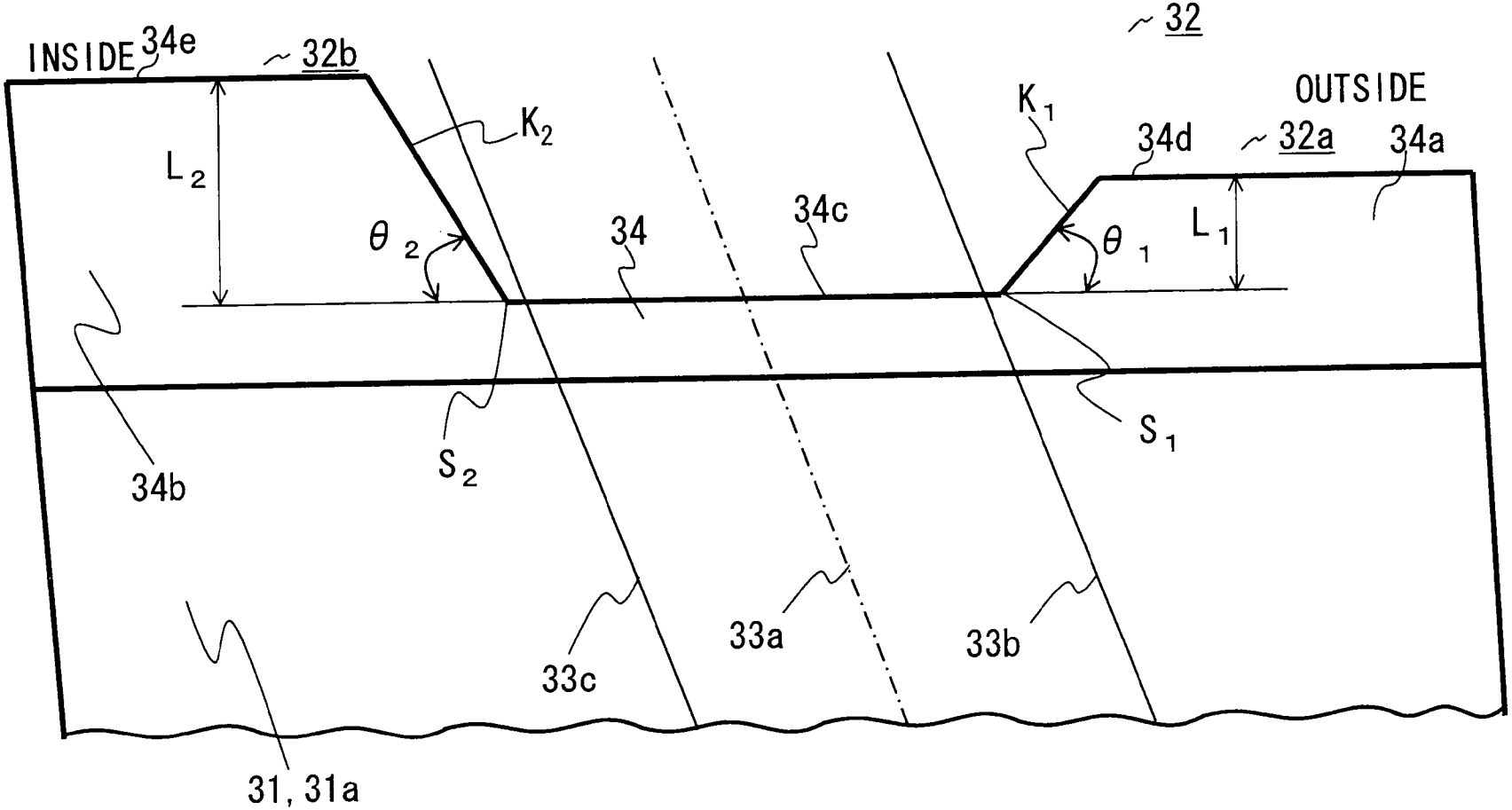

【FIG 4】
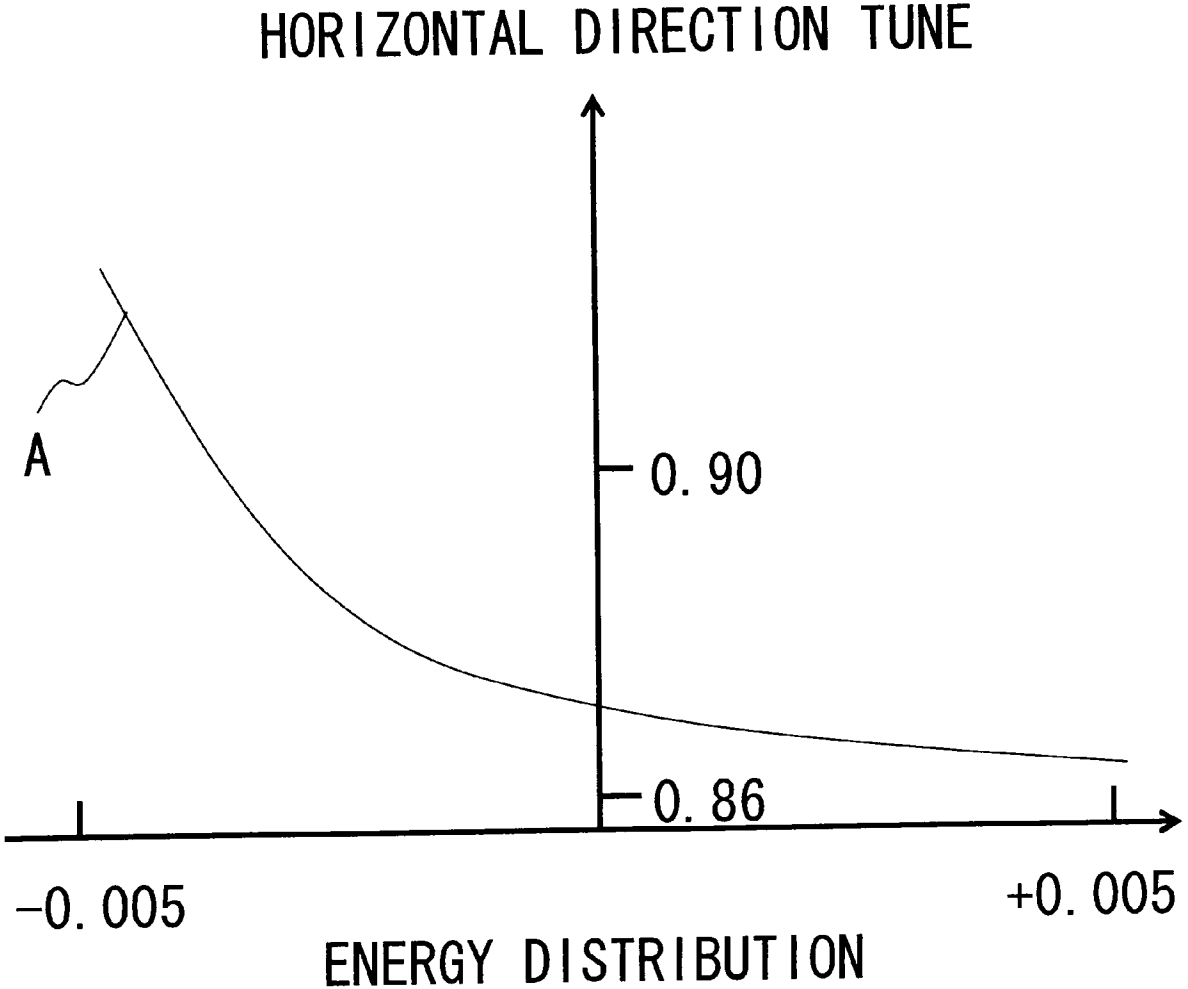

【FIG 5】
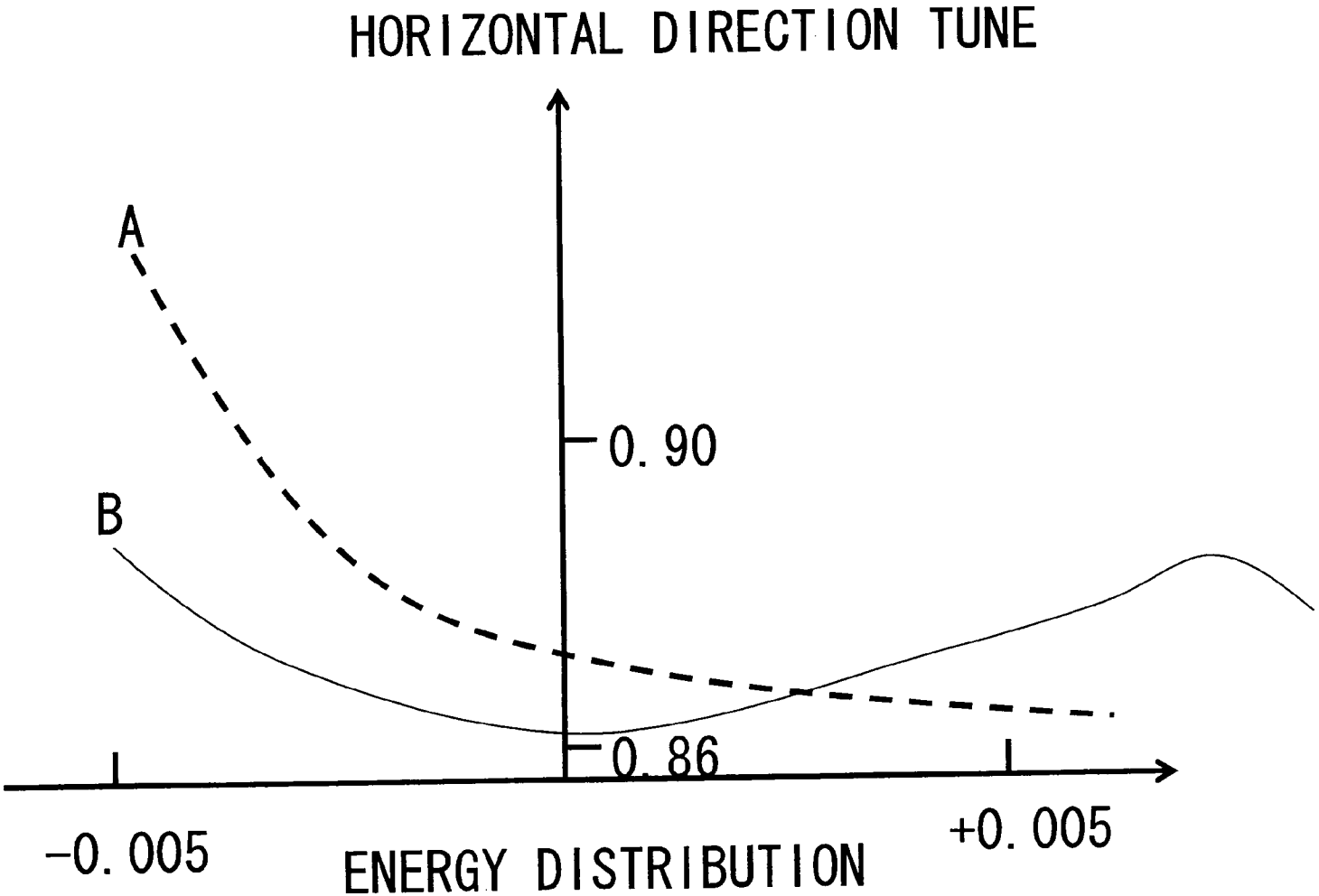

[FIG 6]
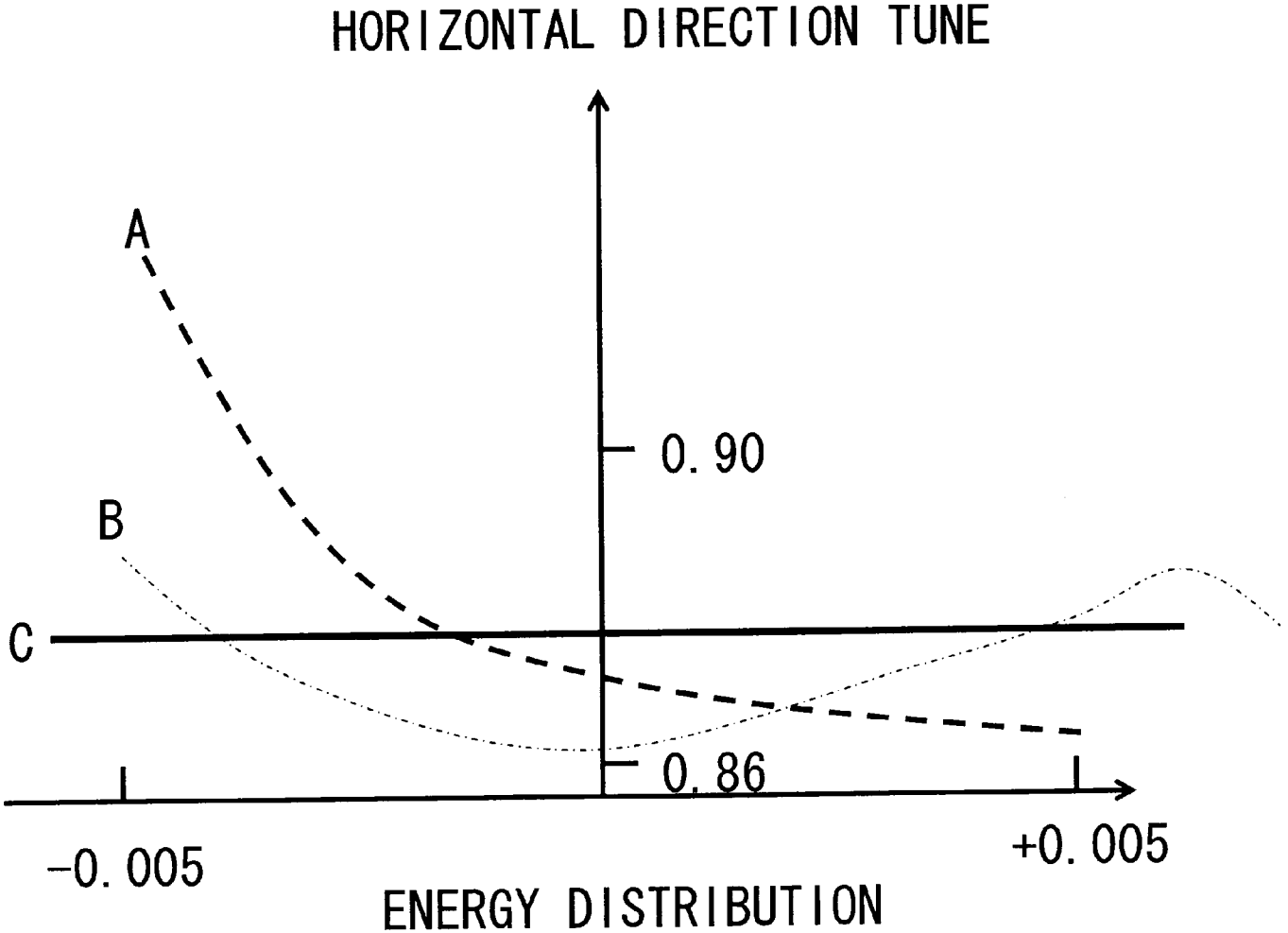

【FIG 7】
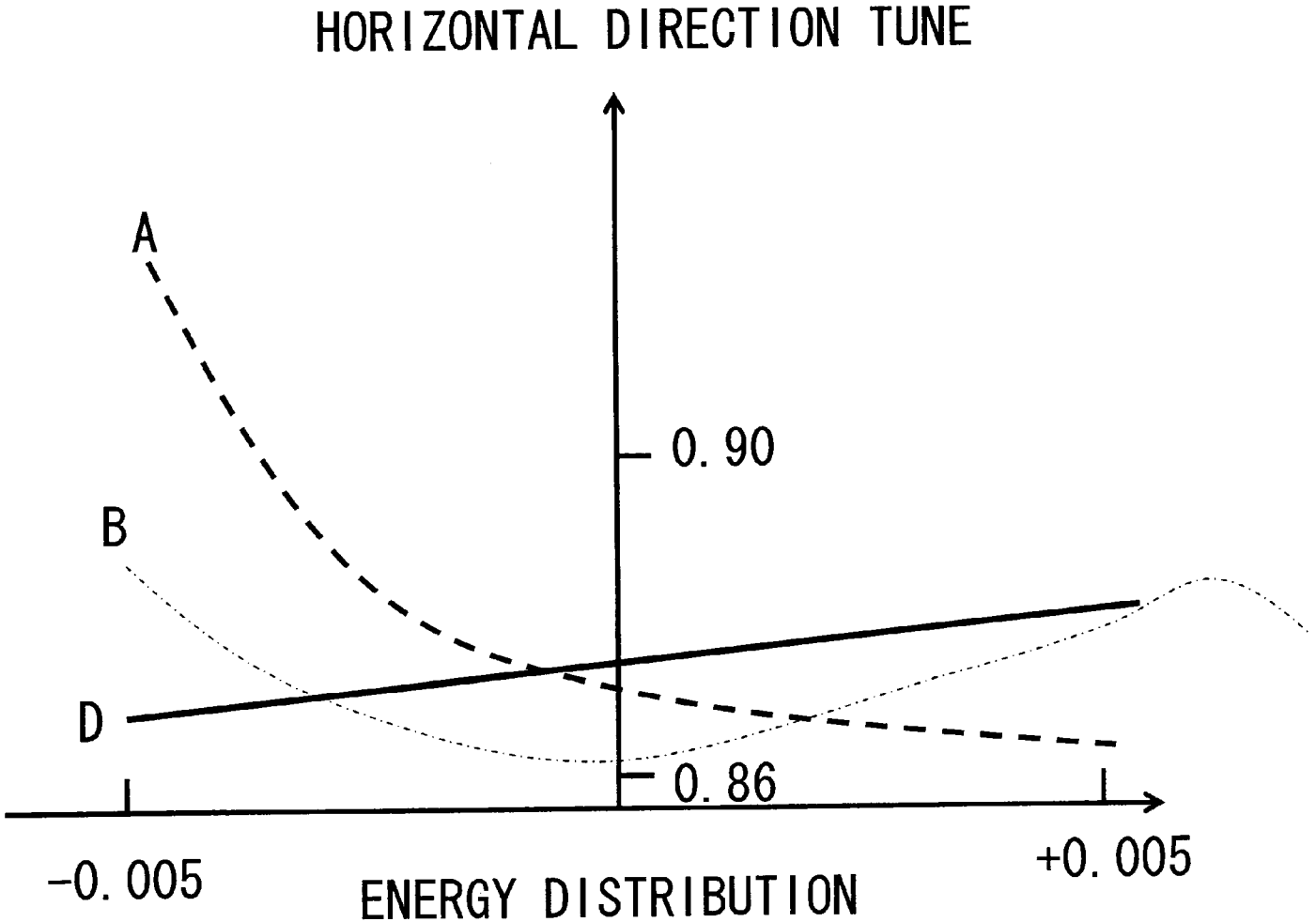

【FIG 8】
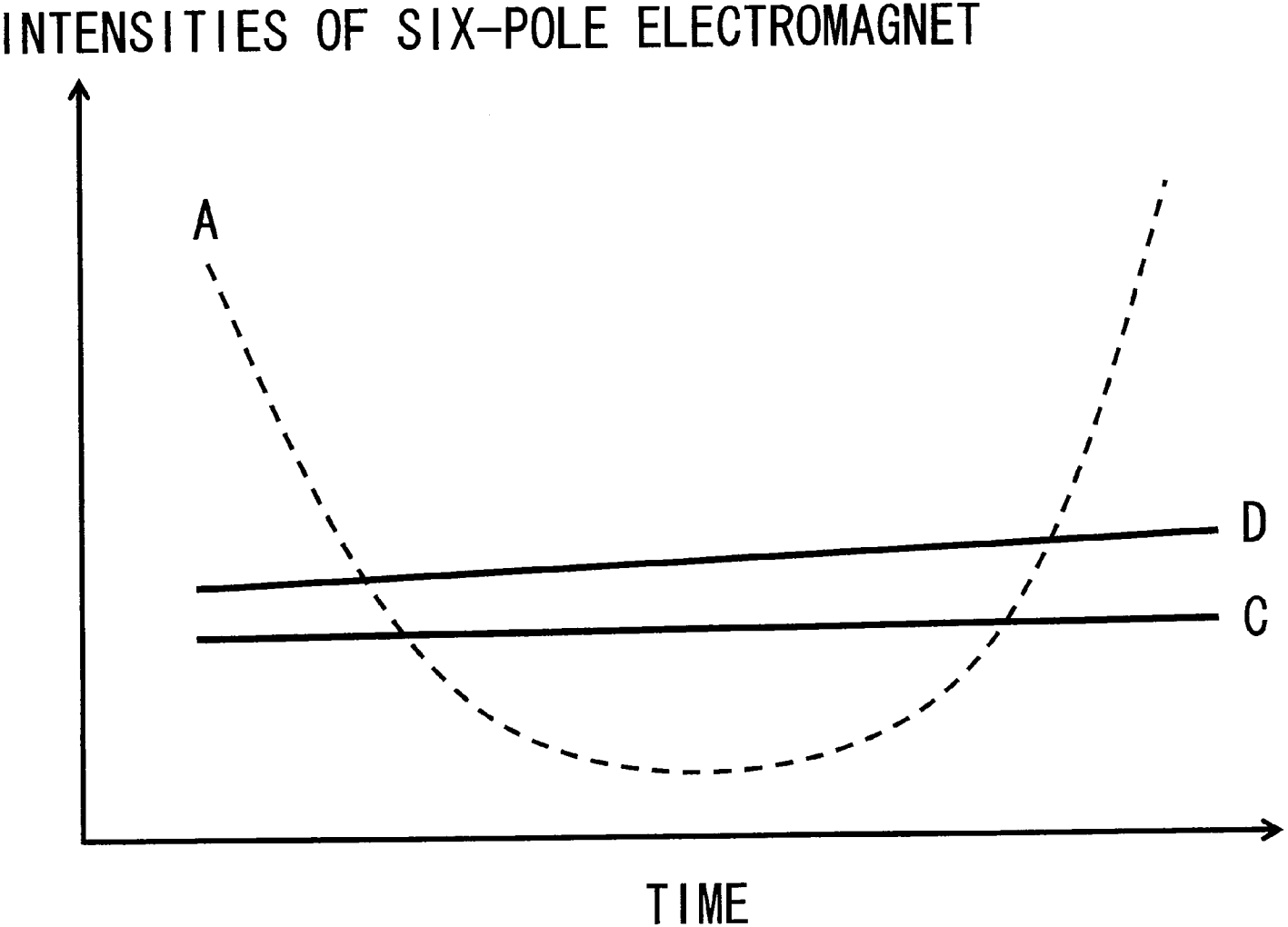

【FIG 9】
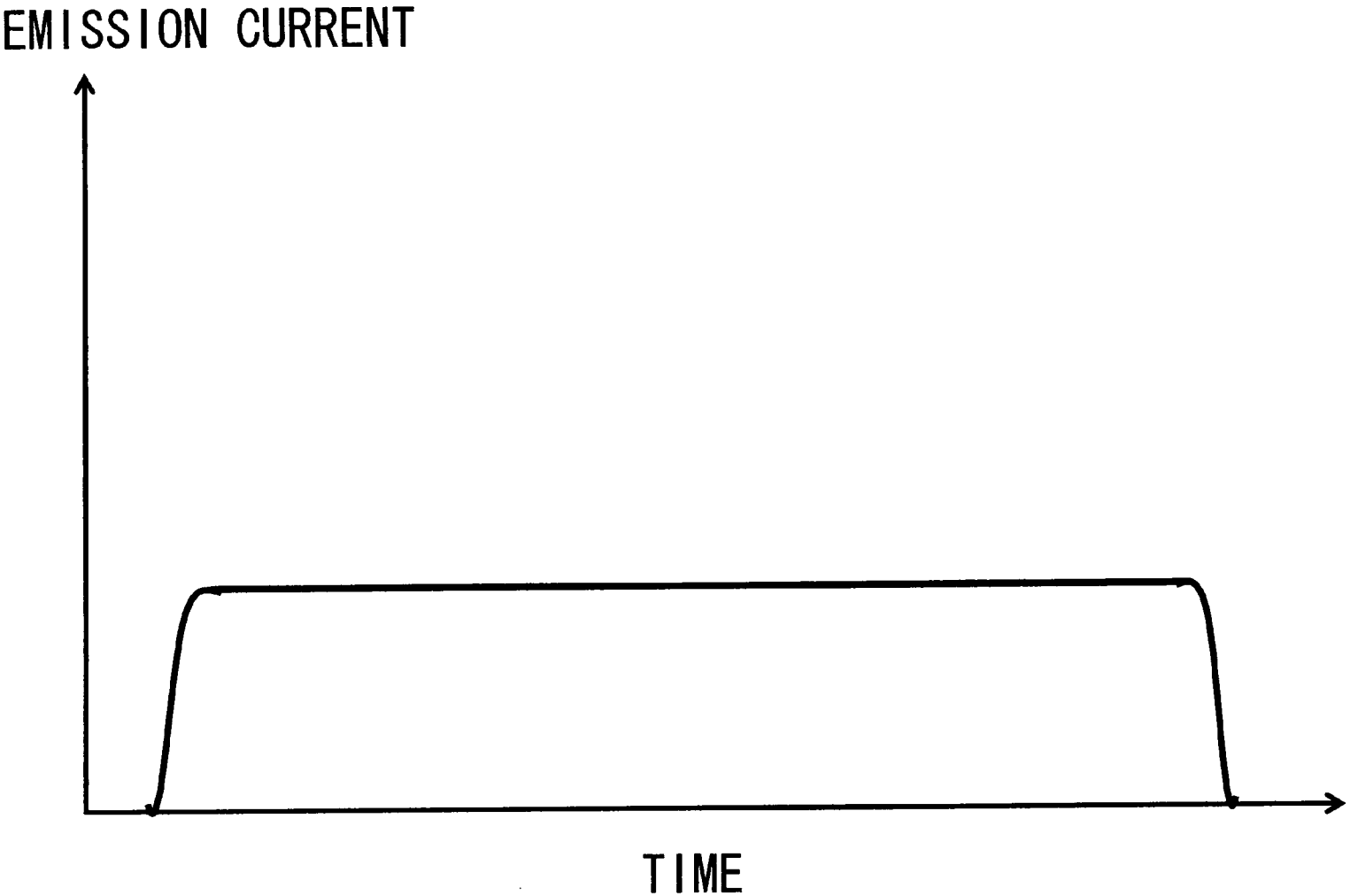

【FIG 10】
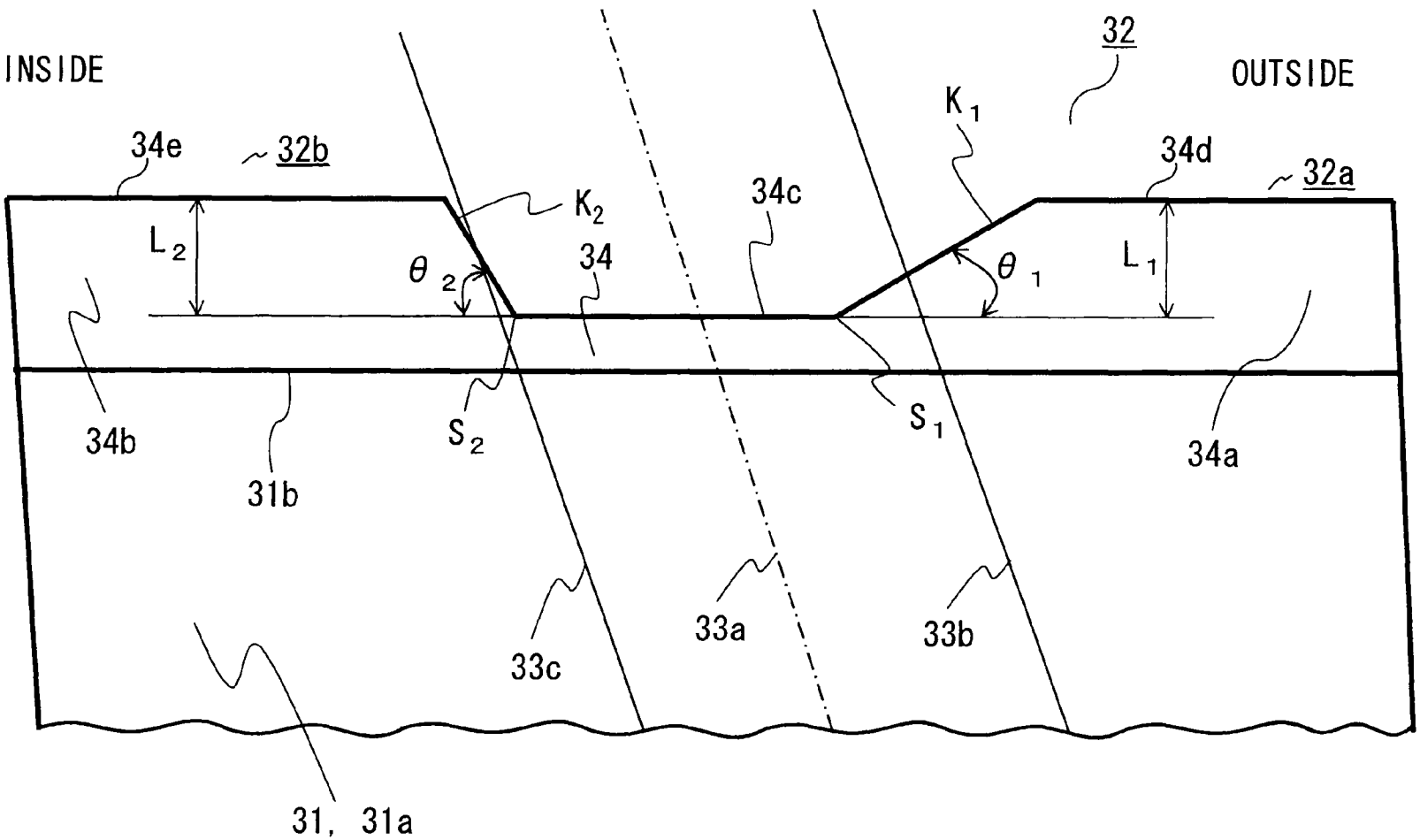

[FIG 11]
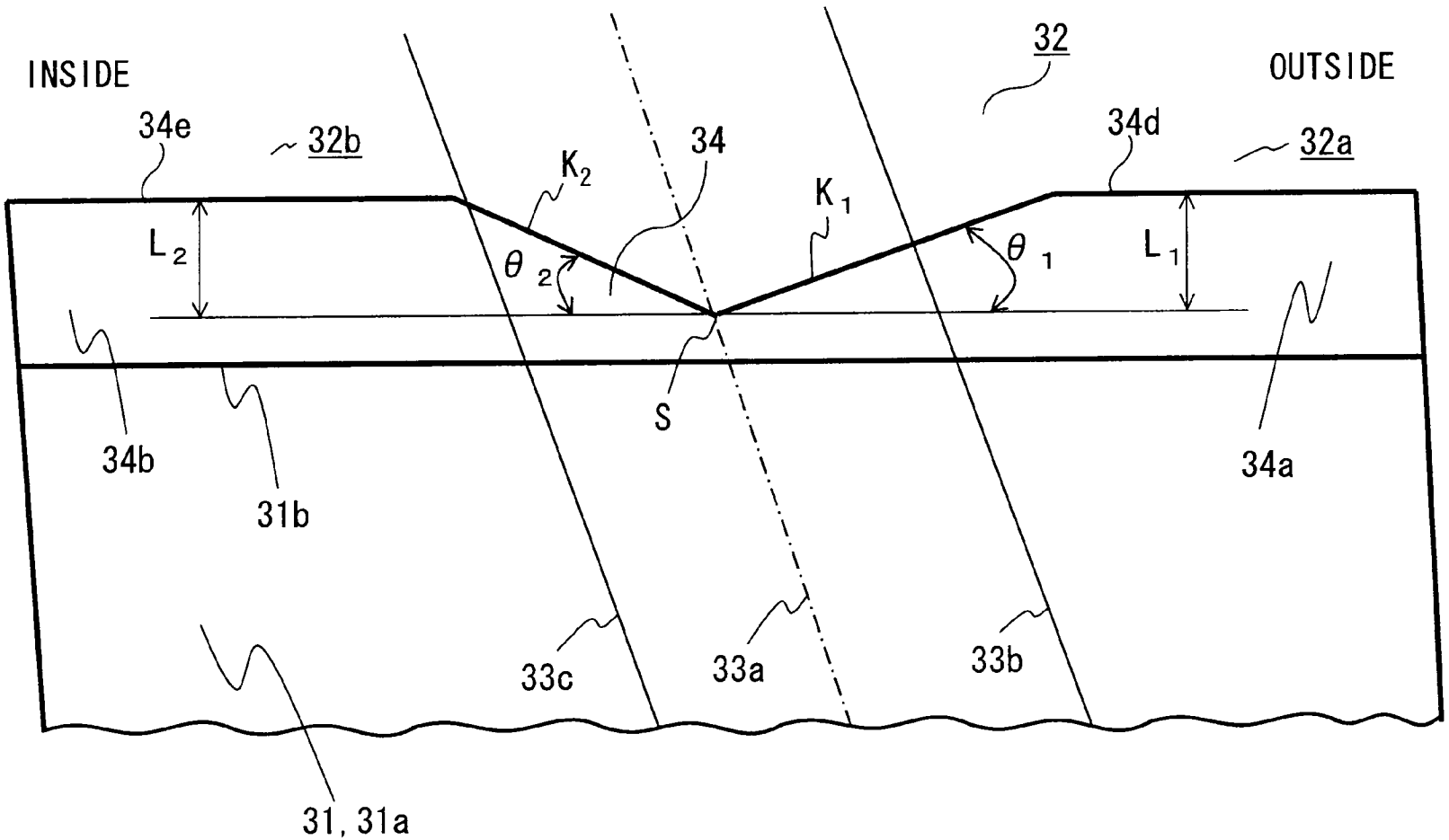

【FIG 12】
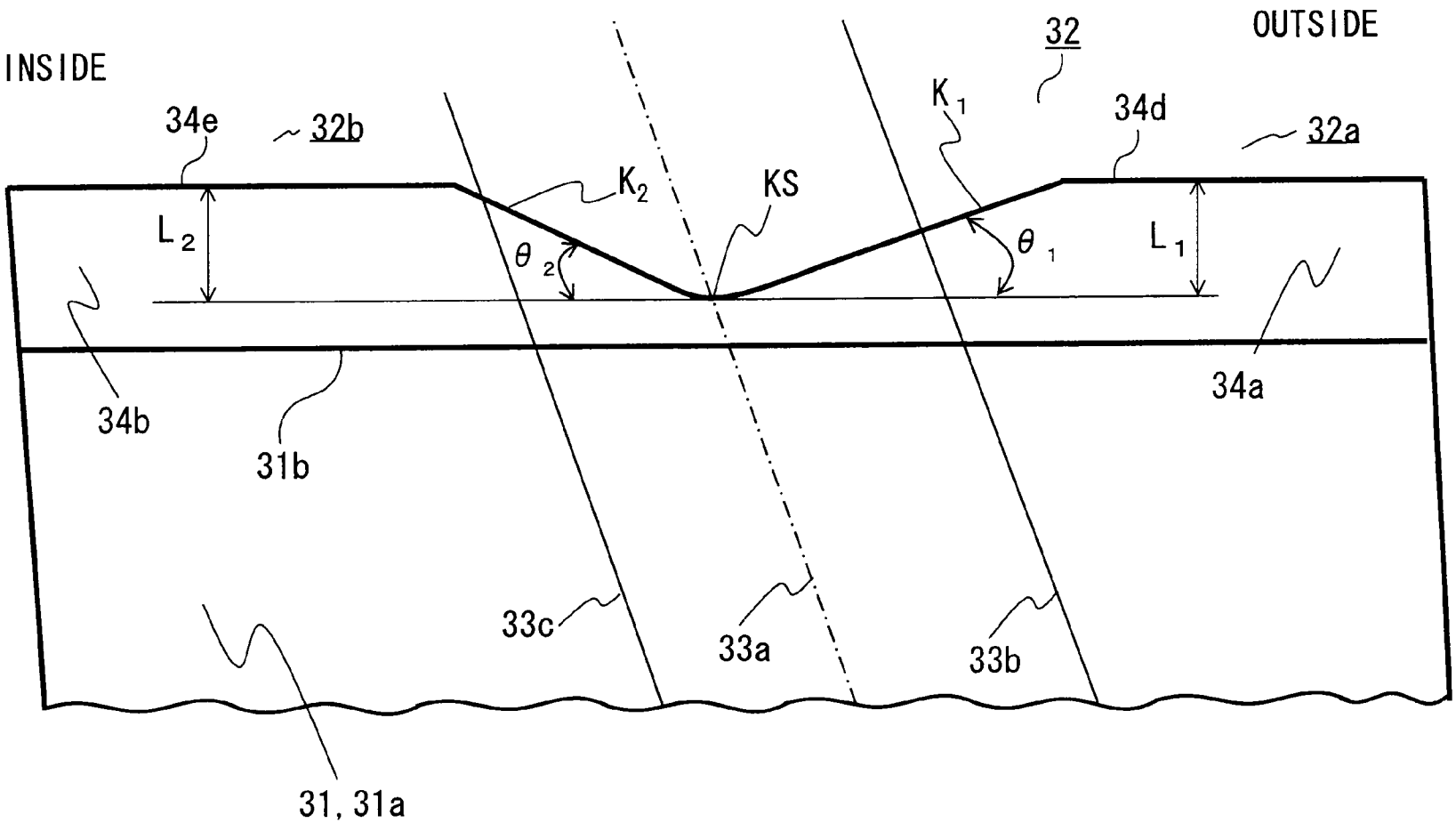

【FIG 13】
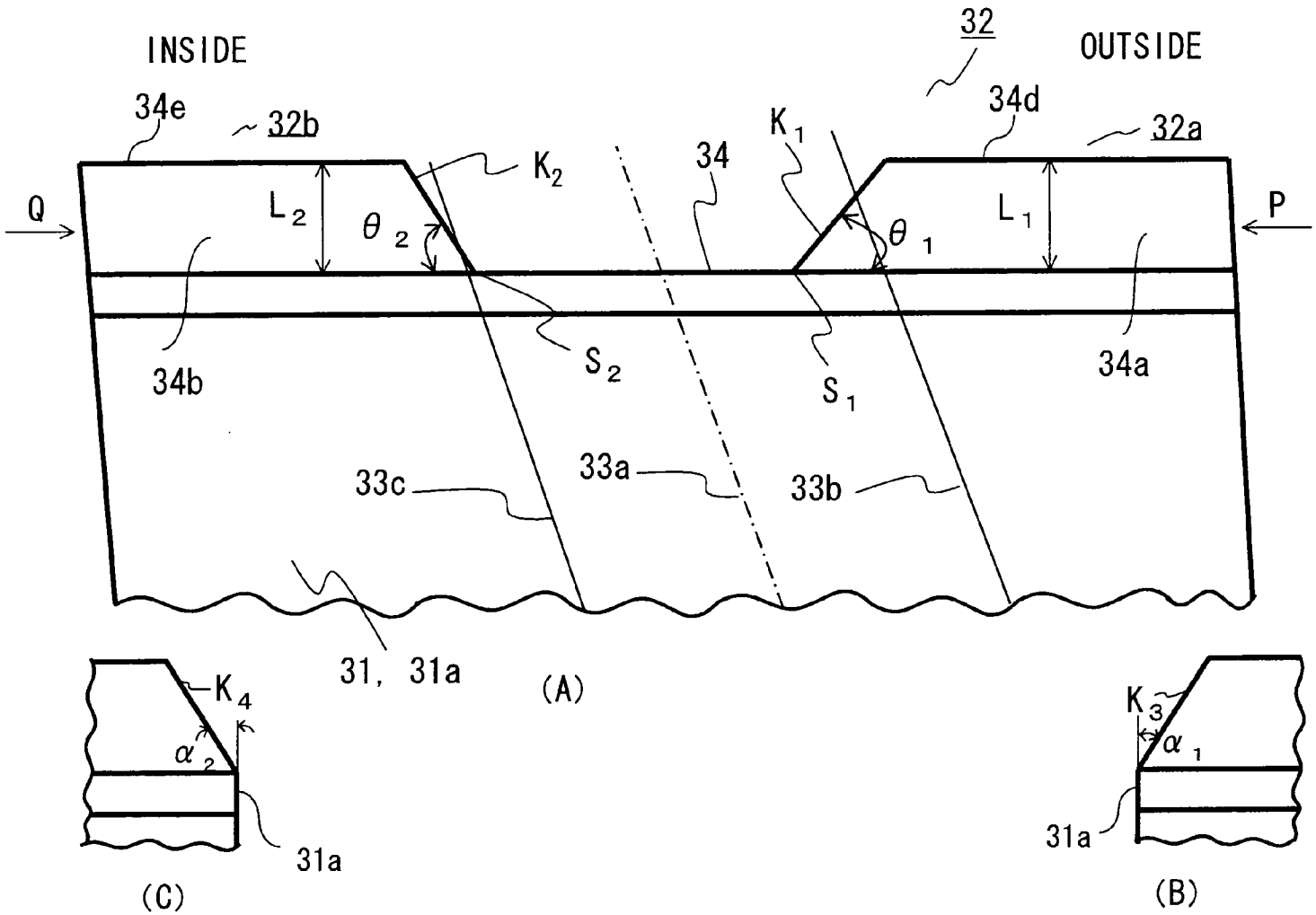

CIRCULAR ACCELERATOR

BACKGROUND OF THE INVENTION

1. Field of the Invention

This invention relates to a circular accelerator into which a low energy beam is entered, and from which a high energy beam accelerated on an equilibrium orbit is emitted.

2. Description of the Background Art

Heretofore, a circular accelerator such as a synchrotron has been used in a physical experiment in which a charged particle beam is revolved and accelerated, and a beam extracted from the equilibrium orbit of the circular accelerator is transported by a beam transport system, so as to irradiate a desired object with the extracted beam, or in the remedy of a cancer or the diagnosis of a diseased part for particle beam medicine.

In such a circular accelerator, the resonance of the betatron oscillations of the beam has been employed in order to continuously emit accelerated charged particles. The "resonance of the betatron oscillations" is a phenomenon as stated below. The charged particles revolve while oscillating rightwards and leftwards (in a horizontal direction) or upwards and downwards (in a vertical direction) around the equilibrium orbit of the circular accelerator. This is termed the "betatron oscillations". The oscillation number of the betatron oscillations per a revolution of the revolving orbit is generally called a "tune (a betatron oscillation number)". The tune can be controlled by a bending electromagnet, a four-pole electromagnet or the like which is disposed on the revolving orbit. When the fractional part of the tune is brought near to a/b (where a and b denote integers), and simultaneously, a multipole magnet for generating the resonance (for example, a six-pole electromagnet) disposed on the equilibrium orbit is excited, the amplitude of the betatron oscillations of the charged particles which have betatron oscillation amplitudes of or larger than a certain fixed amplitude, among the large number of charged particles revolving, increases suddenly. This phenomenon is called the "resonance of the betatron oscillations", and the boundary part between a stable region and an unstable region is termed a "stable limit (separatrix)". The magnitude of the betatron oscillation amplitude of the stable limit of the resonance depends upon a deviation from the fractional part of the tune, and it becomes smaller as the deviation is smaller. The beam outside the separatrix becomes unstable, and it is gradually extracted out of the circular accelerator. In this manner, the delicate adjustment of the tune is required in the resonance emission, and a long time is expended on the adjustments of emission parameters.

As methods for performing such resonance emissions, the following four methods have heretofore been known extensively and generally:

[Method 1] The magnitude of a separatrix is gradually made small from an initial large state. A resonance is first generated for charged particles of large betatron oscillation amplitude among charged particles revolving, and resonances are thereafter generated for the charged particles of smaller oscillation amplitudes in succession. Thus, charged particle beams are gradually emitted from an emission unit into an irradiation chamber.

[Method 2] A stable limit is made constant by holding a tune constant, and the amplitude of the betatron oscillations of a beam is increased by high frequencies, thereby to generate a resonance.

[Method 3] A stable limit is made substantially constant by holding a tune substantially constant, and the amplitude of the betatron oscillations of a beam is increased by high frequencies, so as to enlarge the beam to the boundary of the stable limit. Thereafter, a four-pole electromagnet is excited to make a separatrix somewhat smaller. Thus, a charged particle beam is gradually extracted.

[Method 4] A stable limit is made substantially constant by holding a tune substantially constant, and a beam is gradually accelerated by a high-frequency acceleration electric field. Thus, the beam having come outside the separatrix is gradually extracted.

With any of the above methods, the charged particles do not revolve round a center orbit only, but they pass through various parts outside the center orbit and inside the center orbit. In that case, in a prior-art example, the change of the tune is corrected by temporally controlling a six-pole electromagnet or the like. As a concrete example, there has been disclosed a technique wherein, in order to prevent the change of the betatron oscillation number (the tune), attributed to the fact that the equilibrium orbit is shifted by the change etc. of the exciting current of a bending electromagnet, a four-pole electromagnet, a function coupling type electromagnet or the like, and to stably emit the charged particle beam, a six-pole electromagnet which cancels the change of the tune attributed to the exciting current of the bending electromagnet or the four-pole electromagnet is disposed in addition to a six-pole electromagnet for the resonance emission, and the additional six-pole electromagnet is fed with an exciting current which gives the revolving beam a diverging force or a converging force that cancels the change of the tune attributed to the exciting current of the bending electromagnet or the four-pole electromagnet (refer to, for example, Patent Document 1 being JP-A-11-074100).

However, a revolving type accelerator indicated in Patent Document 1 has had the following problems:

(1) The six-pole electromagnet or the like needs to be subjected to a complicated control in order to prevent the change of the tune attributed to the discrepancy of the equilibrium orbit as is ascribable to the change of the exciting current of the bending electromagnet or the other electromagnet, and a long time is expended on beam adjustments.

(2) Even in the emission of identical energy, in the case of the resonance emission, the charged particle beam passes on different beam orbits in the course of making the separatrix smaller. Therefore, a complicated control is required for preventing the change of the tune attributed to the change of the orbit, and a long beam adjustment time is expended.

SUMMARY OF THE INVENTION

This invention has been made in order to solve the above problems, and it has for its object to provide a circular accelerator in which the change of a tune is statically corrected, and the tune is changed substantially linearly even when an equilibrium orbit has shifted, whereby a beam can be emitted stably with a simple control, and a beam adjustment time can be shortened, with the result that a cost is lowered.

A circular accelerator according to this invention, wherein a charged particle beam revolves round an equilibrium orbit, includes bending electromagnets which generate a bending magnetic field, a six-pole electromagnet which generates a magnetic field for correcting a difference of betatron oscillations attributed to a difference of energy of the charged particle beam, and an emission device which extracts the charged particle beam out of the circular accelerator from the equilibrium orbit. Here, each of those magnetic pole edge portions of each of the bending electromagnets into and from which the charged particle beam enters and exits is additionally provided with an endpack which is provided with a first protrusion at a part radially outside a beam equilibrium orbit having center energy of the charged particle beam, and a second protrusion at a part radially inside the beam equilibrium orbit. Shapes of the first and second protrusions are formed so that betatron oscillation numbers of beams of different energies may be held constant or become linear to the energies, within a range of acceleration energies of the charged particle beam.

Since such bending electromagnets are included, the time dependency of the magnetic field intensity of the six-pole electromagnet at a resonance emission conforms to a simple linear function. Accordingly, the adjustments of emission parameters at the time when the energy of charged particles accelerated during the emission has changed become easy, and an initial beam adjustment period, for example, at the construction of the circular accelerator, or after shutdown for a long term or after the partial remodeling of an apparatus can be sharply shortened. Thus, this invention has the advantage that the circular accelerator which enhances the reliability of running and which involves a low cost can be realized.

The foregoing and other objects, features, aspects and advantages of the present invention will become more apparent from the following detailed description when read in conjunction with the accompanying drawings.

BRIEF DESCRIPTION OF THE DRAWINGS

FIG. 1 is a view showing the equipment arrangement of a circular accelerator in a first embodiment;

FIGS. 2A and 2B are views showing the magnetic pole parts of a bending electromagnet in the first embodiment;

FIG. 3 is a view showing a magnetic pole edge portion in the first embodiment on an enlarged scale;

FIG. 4 is a graph showing the energy dependency of a tune in a horizontal direction in the case where the magnetic pole edge portion is not provided with endpacks;

FIG. 5 is a graph showing the energy dependency of the tune in the horizontal direction in the case where the lengths of the endpacks are equalized and where angles defining inclined surfaces are set at $\theta_2>\theta_1$;

FIG. 6 is a graph showing the energy dependency of the tune in the horizontal direction according to the first embodiment;

FIG. 7 is a graph showing the energy dependency of the tune in the horizontal direction according to another example of the first embodiment;

FIG. 8 is a graph showing the time dependencies of the intensities of a six-pole electromagnet during resonance emissions according to the first embodiment;

FIG. 9 is a graph showing an emission beam current during a beam emission according to the first embodiment;

FIG. 10 is a view showing a magnetic pole edge portion in a second embodiment on an enlarged scale;

FIG. 11 is a view showing a magnetic pole edge portion in a third embodiment on an enlarged scale;

FIG. 12 is a view showing a magnetic pole edge portion in a fourth embodiment on an enlarged scale; and FIGS. 13A, 13B and 13C are views showing a magnetic pole edge portion in a fifth embodiment on an enlarged scale.

DETAILED DESCRIPTION OF THE PREFERRED EMBODIMENTS OF THE INVENTION

First Embodiment

The first embodiment of this invention will be described in conjunction with the drawings.

FIG. 1 is a view showing the equipment arrangement of a circular accelerator 100 according to the first embodiment. As is extensively known, the circular accelerator 100 is such that charged particles entered from a prestage accelerator 9 and through a beam transport system 1 are accelerated while being revolved around an equilibrium orbit 4 which is a revolving orbit, and that the charged particles are thereafter fed into an irradiation chamber, not shown, through an emission device 7 as well as an emitting beam transport system 8.

As shown in FIG. 1, the circular accelerator 100 includes an entrance device 2 which enters the beam of the charged particles, for example, protons transported from the prestage accelerator 9, a high-frequency acceleration cavity 5 which gives energy to the charged particles, bending electromagnets 3 which bend the beam orbit, a six-pole electromagnet 6 which excites a resonance at the emission of the accelerated charged particle beam, that is, which generates a magnetic field for dividing the betatron oscillations of the charged particle beam into a stable region and a resonance region, and the emission device 7 by which the proton beam of increased betatron oscillation amplitude is emitted into the emitting beam transport system 8. Incidentally, the depiction of the equilibrium orbit 4 between the adjacent ones of the four bending electromagnets 3 is omitted. Further, the depictions of endpacks 34 and the first and second protrusions 34*a* and 34*b* thereof to be explained later with reference to FIG. 2B are omitted.

Enlarged views of each bending electromagnet 3 and the magnetic pole parts thereof are shown in FIGS. 2A and 2B.

FIG. 2A is a side view of the bending electromagnet 3, while FIG. 2B is the enlarged view of the magnetic pole 31 of the bending electromagnet 3 as seen in the direction of arrows A-A in FIG. 2A. Referring to FIG. 2A, the bending electromagnet 3 includes the magnetic poles 31 which have magnetic pole faces 31*a* opposing to each other through a magnetic pole gap G, and coils 39 which generate a bending magnetic field. As shown in FIG. 2B, the magnetic poles 31 of the bending electromagnet 3 bend the beam orbit at a bending angle θb with Q being a center point of bending radius R. Each magnetic pole 31 has a magnetic pole edge portion 32. Besides, in the first embodiment, the outer peripheral side of the magnetic pole edge portion with respect to the bending radius R shall be called the "edge outside part 32*a*", and the inner peripheral side the "edge inside part 32*b*".

As shown in FIG. 2B, the equilibrium orbit 4 shown in FIG. 1 corresponds generically to the equilibrium orbit 33*a* of a beam of center energy as corresponds to a beam center orbit, the equilibrium orbit 33*b* of a beam of higher energy than the center energy (higher energy beam), and the equilibrium orbit 33*c* of a beam of lower energy than the center energy (lower energy beam). Those parts of the magnetic pole edge portion 32 which correspond to the beam inlet 35*a* and beam outlet 35*b* of the magnetic pole 31 are additionally provided with the endpacks 34 to be stated later.

In order to bestow a converging action on the charged particles 4 which are accelerated, the angle θe between the magnetic pole edge portion 32 and a straight line which connects the beam center orbit 33*a* and the center point Q of the bending radius R is made larger than zero degree with a clockwise direction taken as plus in FIG. 2B. This angle θe is generally termed the "edge angle". As the edge angle θe is larger, a beam converging force in a vertical direction as is perpendicular to the drawing sheet of FIG. 2A becomes larger, and a beam converging force in a horizontal direction becomes smaller. On the other hand, the main part of the magnetic pole 31 extending over the bending angle θb of the bending electromagnet 3 has the converging force in the horizontal direction, but it has no converging force in the vertical direction.

Owing to the above, a stable solution which converges the beam in both the horizontal direction and the vertical direction can be determined by properly selecting the edge angle θe. As is extensively and generally known, the edge angle is set to be plus as shown in FIG. 2B, in each of substantially all circular accelerators. In that case, a proportion occupied by the magnetic pole 31 becomes smaller at the edge inside part 32*b* than at the edge outside part 32*a*, and inevitably a magnetic field intensity distribution in the magnetic pole edge portion 32 becomes weaker at the edge inside part 32*b*.

The reason therefor is as stated below. Usually, in a general bending electromagnet, a magnetic field intensity at the boundary part of a magnetic pole is substantially similar on a beam center orbit, and inside and outside the beam center orbit. However, in a case where the edge angle is large on the plus side (where it exceeds 10 degrees: about 30 degrees in the first embodiment), the magnetic field intensity becomes lower inside the boundary part of the magnetic pole. In more detail, the magnetic field intensity of the whole electromagnet becomes higher at a part of lower reluctance, and in the case where the edge angle is large on the plus side, the reluctance inside the boundary part of the magnetic pole becomes larger than that outside the boundary part, on the basis of a three-dimensional effect. Consequently, the beam converging force differs between inside and outside the boundary part, and a tune becomes nonlinear. To turn the nonlinear tune into a linear tune is the point of this invention including the first embodiment.

FIG. 3 shows an enlarged view of the magnetic pole edge portion 32 in the vicinity of the beam outlet side 35*b* of the magnetic pole 31.

The magnetic pole end face 31*b* of the magnetic pole 31 of the bending electromagnet 3 is additionally provided with the endpack 34. This endpack 34 is provided with the first protrusion 34*a* in a place corresponding to the edge outside part 32*a*, and with the second protrusion 34*b* at the edge inside part 32*b*. Also, the endpack 34 is located in close touch with the magnetic pole end face 31*b* so as to stretch in the direction of the beam revolving orbit and to form a plane identical to the magnetic pole face 31*a*.

Besides, an endpack end face 34*c* which joins the bottom sides of the respective protrusions 34*a* and 34*b* is formed between the first and second protrusions 34*a* and 34*b* of the endpack 34, and this endpack end face 34*c* is provided so as to become parallel to flat parts 34*d* and 34*e* which correspond to the top sides of the first and second protrusions 34*a* and 34*b*. Incidentally, the magnetic pole end face 31*b* and the endpack end face 34*c* need not always be parallel. A length from the endpack end face 34*c* to the protrusion flat part (the height of the protrusion) is denoted by "$L_1$" in the first protrusion 34*a* and by "$L_2$" in the second protrusion 34*b*, and $L_2>L_1$ is set in the first embodiment. That is, the protrusion flat parts 34*d* and 34*e* do not form an identical plane.

Besides, the first protrusion 34*a* is provided with a first equilibrium-orbit-side end part $K_1$ which extends from an initial point $S_1$ on the bottom side of this protrusion, namely, the endpack end face 34*c* to the flat part 34*d*, and which defines an inclination angle $\theta_1$ with the bottom side lying radially outside the equilibrium orbit of the beam. The initial point $S_1$ is set to lie radially outside the high-energy-beam equilibrium orbit 33*b*.

Besides, the second protrusion 34*b* is similarly provided with a second equilibrium-orbit-side end part $K_2$ which extends from an initial point $S_2$ on the bottom side to the flat part 34*e*, which has a predetermined inclination angle $\theta_2$ radially inside the equilibrium orbit. The initial point $S_2$ is set to lie radially inside the low-energy-beam equilibrium orbit 33*c*. In addition, the relation between the angles $\theta_1$ and $\theta_2$ is held at $\theta_2>\theta_1$ in the first embodiment.

The magnetic pole end face 31*b* is additionally provided with the endpack 34 having such first and second protrusions 34*a* and 34*b*, whereby the weakening of the magnetic field distribution of the edge inside part 32*b* of the magnetic pole edge portion 32 can be corrected. Incidentally, although the example in which the endpack 34 has the first and second protrusions 34*a* and 34*b* has been indicated in the first embodiment, only the first and second protrusions 34*a* and 34*b* or two separate endpacks may well be attached to the magnetic pole end face 31*b*. In this case, the magnetic pole end face 31*b* may well be stepped unlike a flat surface. Besides, although the endpack shape in the beam revolving direction has been explained in the first embodiment, an end shape in the radial direction is not especially restricted.

FIG. 4 shows the computed result of the energy dependency of the tune representing a beam convergence characteristic in the horizontal direction, the result having been obtained using a three-dimensional magnetic field and an orbital analysis code. Since only the tune in the horizontal direction becomes a controlled variable in the resonance emission, only the dependency in the horizontal direction is shown. The computed result corresponds to a case where a magnetic pole is not provided with the first and second endpacks 34*a* and 34*b* in FIG. 3. As shown in FIG. 3, the beam having the lower energy than the center energy passes through the inner side of the bending electromagnet, and the beam having the higher energy than the center energy passes through the outer side of the bending electromagnet, so that the magnetic field intensity distribution in the magnetic pole edge portion 32 becomes weaker at the edge inside part 32*b*. Therefore, the converging force in the lateral direction becomes intenser on the inner side than on the outer side.

FIG. 5 shows another example B which indicates the energy dependency of the tune representing the beam convergence characteristic in the horizontal direction. In FIG. 5, the result in FIG. 4 is simultaneously shown at a broken line A. The computed result of the example B corresponds to a case where the lengths of the first and second protrusions 34*a* and 34*b* in FIG. 3 are set at $L_1=L_2$ and where the inclination angles are set at $\theta_2>\theta_1$. In each of the example A in FIG. 4 and the example B in FIG. 5, the energy dependency of the tune in the horizontal direction is nonlinear, and a complicated electromagnet control is required at the resonance emission of the beam.

On the other hand, FIG. 6 shows at a solid line C another example which indicates the energy dependency of the tune representing the beam convergence characteristic in the horizontal direction. The computed result of the example C in FIG. 6 corresponds to the case of the shapes of the first and second protrusions 34*a* and 34*b* shown in FIG. 3, that is, the case where $L_2>L_1$ and $\theta_2>\theta_1$ are set. Here, the shape of the magnetic pole is optimized so that the tune in the horizontal direction may not change even when the energy is changed. Under such conditions, the tune is linear in spite of the change of the energy, and the conditions of the emission become very simple. The result in FIG. 6 has no energy dependency, but this is not always the optimal condition for the emission. At the time of the emission, the six-pole electromagnet 6 is excited so as to set the separatrix at a predetermined magnitude. The reason therefor is that, the energy dependency of the tune in the horizontal direction holds a linearity in a case where it was linear without exciting the six-pole electromagnet 6, but that when the six-pole electromagnet is excited, the inclination of the energy dependency changes. For the magnetic pole shaping in this invention including the first embodiment, it is essential that the energy dependency becomes linear, and it is not necessary to quite nullify the energy dependency. Accordingly, the energy dependency is not held constant, but it can be linearly changed by optimizing the shapes and arrangement of the first and second protrusions 34*a* and 34*b*. An example of such a linear energy dependency is shown at a solid line D in FIG. 7.

FIG. 8 shows the computed results of the time dependencies of the intensities of the six-pole electromagnet 6 during certain resonance emissions in the cases of the example A in FIG. 5, the example C in FIG. 6 and the example D in FIG. 7 for performing the resonance emissions. In the case of the example A, the magnetic field intensity of the six-pole electromagnet 6 needs to be changed every moment, and a long adjustment time is expended at an initial beam adjustment. On the other hand, in the case of the example C or D, the time dependency of the intensity of the six-pole electromagnet 6 conforms to a simple linear function, and a beam adjustment period can be sharply shortened. Incidentally, the six-pole electromagnet generates a magnetic field which corrects the difference of the betatron oscillations attributed to the difference of the energy of the charged particle beam.

FIG. 9 shows the computed result of the temporal change of a beam current during a beam emission in the case of the example D in FIG. 8. It is seen from FIG. 9 that a very stable beam is continuously emitted.

Second Embodiment

Next, a second embodiment will be described with reference to FIG. 10 which is a partial enlarged view of a magnetic pole edge portion 32.

As shown in FIG. 10, the length $L_1$ of the first protrusion 34*a* of the endpack 34 and the length $L_2$ of the second protrusion 34*b* are equalized, and the inclination angles are set to be $\theta_2>\theta_1$. That is, the flat parts 34*d* and 34*e* of the first and second protrusions 34*a* and 34*b* are identical, and the inclination angles $\theta_1$ and $\theta_2$ are not identical. Besides, the initial point $S_1$ of the first equilibrium-orbit-side end part $K_1$ of the first protrusion 34*a* is set to lie radially inside the equilibrium orbit 33*b* of a higher energy beam, and the initial point $S_2$ of the second equilibrium-orbit-side end part $K_2$ of the second protrusion 34*b* is set to lie radially outside the equilibrium orbit 33*c* of a lower energy beam.

The endpack 34 having such first and second protrusions 34*a* and 34*b* is additionally provided, whereby the energy dependency of the tune as shown at C in FIG. 6 can be made linear in substantially the same manner as in the first embodiment. Accordingly, the adjustments of emission parameters at the change of energy are simplified as in the first embodiment, and an initial beam adjustment period can be sharply shortened.

Third Embodiment

A third embodiment will be described with reference to FIG. 11 which is a partial enlarged view of a magnetic pole edge portion 32.

As compared with FIG. 10 of the second embodiment, FIG. 11 differs only in the fact that the initial points of the first and second equilibrium-orbit-side end parts $K_1$ and $K_2$ of the first and second protrusions 34*a* and 34*b* of the endpack 34 are set at the intersection point S between these end parts and the equilibrium orbit 33*a* of a center energy beam. The others are the same as in FIG. 10.

Also in this case, the energy dependency of the tune can be made linear in the same manner as in the first embodiment. Accordingly, emission parameter adjustments at the change of energy are simplified, and an initial beam adjustment period can be sharply shortened.

Fourth Embodiment

A fourth embodiment will be described with reference to FIG. 12 which is a partial enlarged view of a magnetic pole edge portion 32.

As compared with FIG. 11 of the third embodiment, FIG. 12 differs only in the fact that the first and second equilibrium-orbit-side end parts $K_1$ and $K_2$ of the first and second protrusions 34*a* and 34*b* of the endpack 34 are joined by a smooth curve KS on the equilibrium orbit 33*a* of a center energy beam. The others are the same as in FIG. 11.

Also in this case, the energy dependency of the tune can be made linear in the same manner as in the first embodiment. Accordingly, emission parameter adjustments at the change of energy are simplified, and an initial beam adjustment period can be sharply shortened.

Fifth Embodiment

A fifth embodiment will be described with reference to FIGS. 13A to 13C which are partial enlarged views of a magnetic pole edge portion 32.

As compared with FIG. 10 of the second embodiment, FIG. 13A differs in the fact that inclination angles $\theta_1$ and $\theta_2$ which form first and second equilibrium-orbit-side endparts joining the bottom sides and flat parts 34*d* and 34*e* of the first and second protrusions 34*a* and 34*b* of the endpack 34 are set to be identical. Further, as shown in a side view of FIG. 13B with the first lug 34*a* seen along arrow P, a first inclination surface $K_3$ with which a magnetic pole gap G enlarges more as a position is spaced more in the revolving direction of a beam from the magnetic pole edge portion 32 is provided having a first inclination angle $\alpha_1$ from an endpack face which defines a plane identical to a magnetic pole face 31*a*. Likewise, as shown in a side view of FIG. 13C seen along arrow Q, a second inclination surface $K_4$ is provided having a second inclination angle $\alpha_2$. The first and second inclination angles $\alpha_1$ and $\alpha_2$ are set as $\alpha_1<\alpha_2$. Incidentally, the inclination surfaces $K_3$ and $K_4$ need not be provided in only the first protrusion 34*a* and second protrusion 34*b* of the endpack 34 and need not be provided over the whole radial surface, either, but they may well be provided at parts. Further, in FIGS. 13B and 13C, the inclination surfaces have been exemplified as being provided in the first and second protrusions 34*a* and 34*b*, but they may well be provided by appropriately setting the inclination angles $\alpha_1$ and $\alpha_2$ in the endpack end face 34. The others are the same as shown in FIG. 10.

Also in the fifth embodiment, the parameter adjustments of an emission at the change of energy are simplified in the same manner as in the first embodiment, and an initial beam adjustment period can be sharply shortened.

An edge effect at the magnetic pole boundary part of the bending electromagnet as explained above in each of the first to fifth embodiments has no energy dependency in a case where the magnetic pole including the endpack protrusions is not magnetically saturated. In actuality, however, the magnetic pole is somewhat saturated on the higher energy side, and hence, some energy dependency arises. Accordingly, the protrusion shapes for bestowing the optimal edge effect become somewhat different depending upon the energy of the revolving particle beam. Since, however, the extent of the difference is small, the intermediate shapes of protrusion shapes (that is, a magnetic pole shape) corresponding to a predetermined energy range are set, whereby an expected edge effect can be bestowed on a particle beam within the predetermined energy range. On the other hand, in the case where the circular accelerator is used for irradiation, it can occur to control an irradiation depth by changing the emission energy of a particle beam.

Regarding the control of the irradiation depth, there is a method wherein, after the emission of the particle beam, the center energy of this particle beam is lowered by employing an energy attenuation device called a "range shifter". In case of largely changing the irradiation depth, there is also adopted a method wherein the emission energy of particles emitted from the accelerator is changed. With a device presently available, the emission energy is changed-over in several stages by way of example.

This invention is applicable to a medical accelerator for performing the remedy of a cancer, the diagnosis of a diseased part, or the like employing a charged particle beam, and accelerators for irradiating any material with a particle beam or for performing a physical experiment.

Various modifications and alterations of this invention will be apparent to those skilled in the art without departing from the scope and spirit of this invention, and it should be understood that this is not limited to the illustrative embodiments set forth herein.

What is claimed is:

1. A circular accelerator wherein a charged particle beam revolves round an equilibrium orbit, comprising:

bending electromagnets which generate a bending magnetic field, a six-pole electromagnet which generates a magnetic field for correcting a difference of betatron oscillations attributed to a difference of energy of the charged particle beam, and an emission device which extracts the charged particle beam out of the circular accelerator from the equilibrium orbit;

wherein each of those magnetic pole end faces of each of said bending electromagnets into and from which the charged particle beam enters and exits is additionally provided with an endpack which stretches so as to form a plane identical to a magnetic pole face in a revolving direction of the charged particle beam, and which is provided with a first protrusion at a part radially outside a beam equilibrium orbit having center energy of the charged particle beam, and a second protrusion at a part radially inside the beam equilibrium orbit; the protrusions have flat parts parallel to each other at end parts in the revolving direction of the charged particle beam; the first protrusion is provided with a first equilibrium-orbit-side end part which extends radially outside the equilibrium orbit of the beam, which has an initial point at a bottom side of the protrusion and leads to the flat part, and which defines an inclination angle $\theta_1$ to the bottom side, while the second protrusion is provided with a second equilibrium-orbit-side end part which extends radially inside the equilibrium orbit of the beam, which has an initial point at a bottom side of the protrusion and leads to the flat part, and which defines an inclination angle $\theta_2$ to the bottom side; and shapes of the first and second protrusions are different due to difference in at least either of coplanarity that the flat parts of the first and second protrusions lie on an identical plane or not, and the identity of the inclination angles $\theta_1$ and $\theta_2$.

2. A circular accelerator as defined in claim 1, wherein an endpack end face which joins the initial points of the first and second protrusions is formed between the respective protrusions, and the endpack end face is parallel to the flat parts of the protrusions.

3. A circular accelerator as defined in claim 2, wherein the flat parts of the first and second protrusions lie on an identical plane; the initial point of the first protrusion lies inside a higher-energy-beam equilibrium orbit which is radially outside the center-energy-beam equilibrium orbit, while the initial point of the second protrusion lies outside a lower-energy-beam equilibrium orbit which is radially inside the center-energy-beam equilibrium orbit; and the inclination angle $\theta_1$ is smaller than the inclination angle $\theta_2$.

4. A circular accelerator as defined in claim 1, wherein the initial point of the first and second protrusions lie at an intersection point with the center-energy-beam equilibrium orbit.

5. A circular accelerator as defined in claim 4, wherein first and second equilibrium-orbit-side end parts of the first and second protrusions are joined by a smooth curve at the initial points.

6. A circular accelerator as defined in claim 2, wherein an end face of the endpack in the beam revolving direction is provided with inclined surfaces in which a magnetic pole gap enlarges more as a position is spaced more in the revolving direction of the beam, and an inclination angle which the inclination surfaces defines with the magnetic pole face is smaller at a radially outside part of the equilibrium orbit of the beam than at a radially inside part.

7. A circular accelerator as defined in claim 2, wherein the endpack is configured of first and second separate endpacks; and the first protrusion is provided in the first endpack, while the second protrusion is provided in the second endpack.

* * * * *